US008141508B2

(12) United States Patent
Levander

(10) Patent No.: US 8,141,508 B2
(45) Date of Patent: Mar. 27, 2012

(54) BARGE ARRANGEMENT AND METHOD FOR OPERATION OF A BARGE ARRANGEMENT

(75) Inventor: Oskar Levander, Turku (FI)

(73) Assignee: Wärtsilä Finland Oy, Vaasa (FI)

( * ) Notice: Subject to any disclaimer, the term of this patent is extended or adjusted under 35 U.S.C. 154(b) by 394 days.

(21) Appl. No.: 12/377,354

(22) PCT Filed: Jun. 8, 2007

(86) PCT No.: PCT/FI2007/050338

§ 371 (c)(1),
(2), (4) Date: Feb. 12, 2009

(87) PCT Pub. No.: WO2008/020114

PCT Pub. Date: Feb. 21, 2008

(65) Prior Publication Data

US 2010/0199904 A1 Aug. 12, 2010

(30) Foreign Application Priority Data

Aug. 14, 2006 (FI) ..... 20065510

(51) Int. Cl.
*B63B 35/08* (2006.01)

(52) U.S. Cl. ..... 114/40; 114/248

(58) Field of Classification Search ..... 114/40, 114/242, 248, 249; 440/6
See application file for complete search history.

(56) References Cited

U.S. PATENT DOCUMENTS 3,735,722 A 5/1973 Hooper et al.
5,218,917 A * 6/1993 Harjula et al. ..... 114/40
5,660,131 A * 8/1997 Gulling et al. ..... 114/40
6,162,105 A 12/2000 Breivik
6,182,593 B1 * 2/2001 Wierick ..... 114/249
6,336,419 B1 * 1/2002 Breivik ..... 114/248
7,186,156 B2 * 3/2007 Le Flem et al. ..... 440/6

FOREIGN PATENT DOCUMENTS

GB 1357327 A 6/1974
WO 9846477 A 10/1998

* cited by examiner

*Primary Examiner* — Lars A Olson

(74) *Attorney, Agent, or Firm* — Chernoff, Vilhauer, McClung & Stenzel

(57) ABSTRACT

The invention relates to a barge arrangement comprising a barge unit with a first end (11) and a second end (12) and a tug unit provided with a propulsion unit, which barge unit is adapted to receive the tug unit at one end. In order to achieve an efficient vessel combination for loading, transport and unloading of cargo the barge unit (102) is adapted to receive a first tug unit (2) at its second end (12) in order to be pushed by the first tug unit (2) with the first end (11) of the barge unit (1) in a forward direction (F) of motion. Further, the barge unit (101) is adapted to receive a second tug unit (3) at its second end (12) in order to be pulled by the second tug unit (3) with the second end (12) of the barge unit (1) in the forward direction (F) of motion.

8 Claims, 6 Drawing Sheets

BARGE ARRANGEMENT AND METHOD FOR OPERATION OF A BARGE ARRANGEMENT

CROSS-REFERENCE TO RELATED APPLICATION

This is a national stage application filed under 35 USC 371 based on International Application No. PCT/FI2007/050338 filed Jun. 8, 2007, and claims priority under 35 USC 119 of Finnish Patent Application No. 20065510 filed Aug. 14, 2006.

TECHNICAL FIELD

The invention relates to a barge arrangement comprising a barge unit with a first end and a second end and a tug unit provided with a propulsion unit, which barge unit is adapted to receive the tug unit at one end.

BACKGROUND ART

Barge arrangements comprising a barge adapted to take cargo and without propulsion power and a tug with propulsion power are generally known. Such barge arrangements often include a propelling tug deployed for several barges. The arrangement is operated by loading/unloading one barge at port while another barge is propelled at sea. This means that the tug with its machinery and crew are in efficient use at sea, whereby less non-productive time is spent in port. Typically such barge arrangements are pusher-barge combinations, where the tug engages the stern of the barge for pushing the barge bow forward. Examples of known barge arrangements are shown e.g. in GB 2 132 566 A and U.S. Pat. No. 4,356,784.

The cited barge arrangements are of an integrated tug-barge (ITB) type, where the tug and barge are locked together in a rigid connection practically forming one unit, whereby there is no movement between the tug and barge. The barge arrangement can also be an articulated tug-barge (ATB) type, where the tug and barge have an articulated or hinged connection, which allows for relative movement in one axis or plane for fore (bow) and aft (stern) pitch.

Normally the known pusher-barge combinations are designed for operation in open sea, whereby conventional ice-breakers are used for assistance for operation in ice conditions.

In an attempt to obtain a multi-purpose ship a so-called double acting ship (DAS) has been developed. In this known ship the bow is a conventional bow for operation in open sea and the stern is designed for ice-breaking purposes and provided with a turnable screw arrangement, e.g. azimuthing pod propulsion. When operating in open sea the ship moves with the bow in a forward direction and when operating in ice conditions the ship moves with the ice-breaking stern in the forward direction. As the propulsion system is turnable, the propeller(s) can be used to flush the ship's hull in order to reduce ice friction. The solution is disclosed e.g. in U.S. Pat. No. 5,218,917. This solution, however, is very expensive in construction and operation. The ship practically has to constructed as an ice-breaker, whereby also the ice-breaking stern is not suitable as a stern for operation in open sea due to its ice-breaking configuration. In addition, crew and machinery are idle in port, as opposed to the known barge arrangement discussed above.

SUMMARY OF THE INVENTION

An object of the present invention is to provide a barge arrangement that overcomes the above disadvantages and provides an efficient vessel combination in view of operation in port as well as in view of operation in two separate conditions with different circumstances. An example of such conditions are open sea and ice conditions.

The basic idea of the invention is to optimize the use of an appropriate load carrying unit as well as to optimize the use of an appropriate propelling unit for operating in various conditions. This may be achieved by utilising one or more barge units and an optional number of tug units, in that the barge unit is adapted to receive a first tug at its second end in order to be pushed by the first tug unit with the first end of the barge unit in a forward direction of motion and in that the barge unit is adapted to receive a second tug unit at its second end in order to be pulled by the second tug unit with the second end of the barge unit in the forward direction of motion.

The varying conditions may be exemplified by having the barge unit being arranged to be pushed by the first tug unit for operation in open sea and the barge unit being arranged to be pulled by the second tug unit for operation in ice conditions.

Preferably, in this case, the first end of the barge unit is designed for operation in open sea, the second end (stern end) of the first tug unit is designed for operation in open sea, and the first end (bow end) of the second tug unit is designed for operation in ice conditions.

Advantageously the barge unit has a tug attachment means at it second end, whereby the first tug unit has a first end (bow end) provided with a first barge attachment means and a second end (stern end) provided with a first propulsion unit and the second tug unit has a first end (bow end) provided with a second propulsion unit and a second end (stern end) provided with a second barge attachment means.

Particularly by having the tug attachment means arranged at different vertical levels with regard to the waterline, the barge unit may easily receive the first tug unit and the second tug unit independent of the loading level of the barge unit, i.e. the barge unit being fully loaded and floating deep in the water, intermediately loaded, or empty, floating high in the water.

The first tug unit and the second tug unit may thus attach to the barge unit and remain on their respective designed floating levels for optimum performance.

Further, the first end of the barge unit may advantageously be designed for operation in open sea, e.g. provided with a bulbous bow.

The first tug unit may have the second end (stern end) designed for a pushing operation in open sea, e.g. provided with a good inflow to the propeller of the first propulsion unit, a low cost propulsion unit, and thus generally having low operating costs. This would mean a conventional mechanical propulsion unit with a shaft line provided with a propeller, preferably a controllable pitch propeller.

The second tug unit may have the first end (bow end) designed for ice-breaking, and further provided with a steerable propulsion unit, advantageously an electric pod propulsion device. This would be advantageous for a pulling operation in ice conditions, even providing for flushing of the ice in the forward direction of motion in said ice conditions. In ice conditions the propeller stream from the propeller flushes the hull and reduces the resistance between the ice pieces and the hull. Further, the pod(s) can be turned around to direct the trust in many directions. The propeller stream can clear any ice that is stuck. The forward propellers can also be arranged to "eat" through any obstructive ice ridges.

The attachment means may advantageously comprise connection notches at the second end of the barge unit for receiving e.g. corresponding connecting wedges at the first end (bow end) of the first tug unit and at the second end (stern) of the second tug unit.

Especially in ice conditions it is advantageous, if the attachment means are of the articulated type. This allows for pitching, which reduces forces in ice, as well as in heavy sea conditions. Also this allows for some gap between the pulling second tug unit and the barge unit, which is a further advantage in said conditions.

The tug unit for use in the barge arrangement has a first end and a second end, whereby the first end is provided with a first barge attachment means or a second propulsion unit and the second end is provided with a first propulsion unit or a second barge attachment means.

BRIEF DESCRIPTION OF THE DRAWINGS

In the following the invention will be described, by way of example only, with reference to the accompanying schematic drawings, in which.

DETAILED DESCRIPTION

Firstly, a barge arrangement according to the invention, including a barge unit, a first tug unit and a second tug unit, will be described in detail in connection with FIGS. 1 to 6.

Secondly, an example of operation of the barge arrangement, including the barge unit, the first tug unit and the second tug unit described in detail as of above, will be described in connection with FIGS. 7 to 10.

Finally, some advantages and alternatives of the present invention will be discussed.

Figure 1:
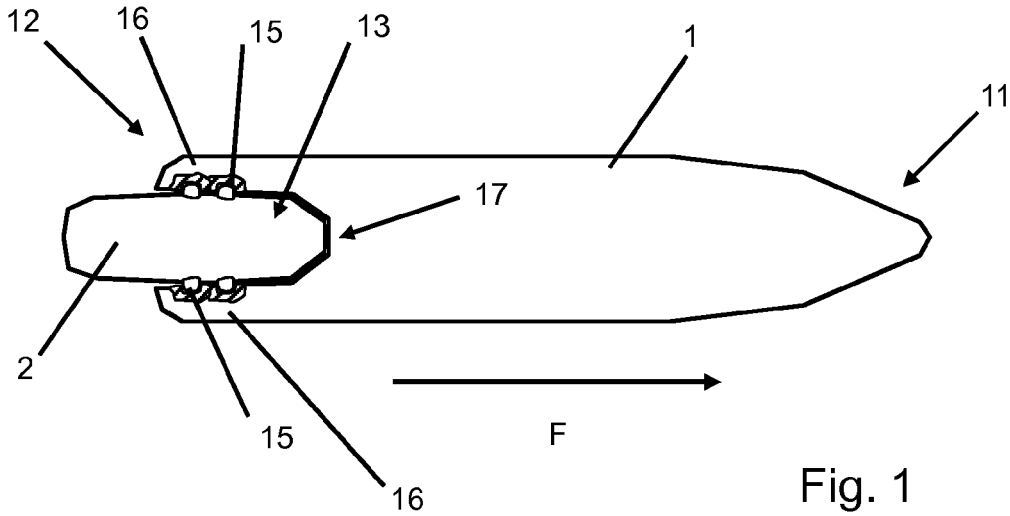
FIG. 1 shows a barge arrangement including a barge unit and a first tug unit from above.
Figure 2:
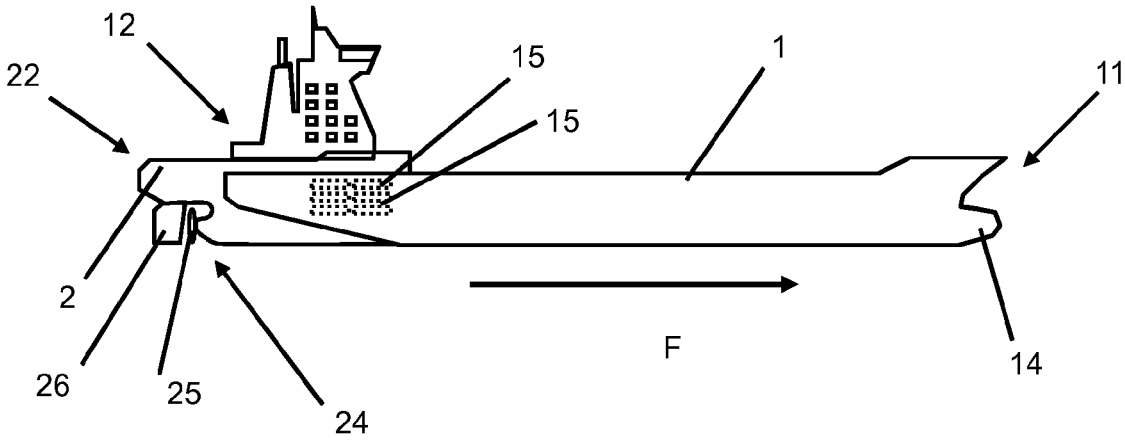
FIG. 2 shows a side view of the barge arrangement of FIG. 1.

FIGS. 1 and 2 show a barge arrangement including a barge unit 1 and a first tug unit 2.

The barge unit 1 has a first end 11, in this embodiment functioning as the bow, and a second end 12, in this embodiment functioning as the stern. The second end 12 of the barge unit 1 is adapted to receive the first tug unit 2 and has a generally U-shaped form opening towards the direction of the second end 12 and providing a recess 13 for receiving the first tug unit 2. The U-shaped second end 12, with two arms 16 and a base 17 between the arms define the recess 13. The first end 11 of the barge unit 1 is provided with a bulbous bow 14. Further, the barge unit 1 is provided with tug attachment means 15, which may be in the form of notches. Preferably, the tug attachment means 15 are on different levels (FIG. 2) with regard to the water level. The tug attachment 15 means are arranged on the inside of the arms 16 of the U-shaped second end 12 of the barge unit 1.

Figure 3:
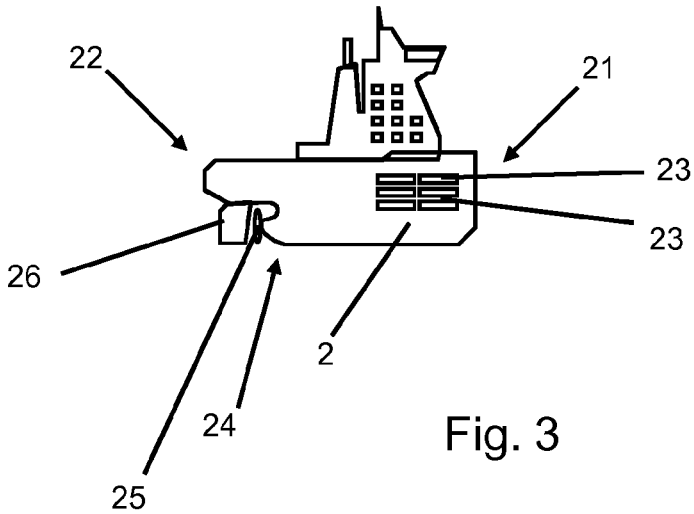
FIG. 3 shows a side view of the first tug unit of FIG. 1.

The first tug unit 2 is shown in more detail in FIG. 3. The first tug unit 2 has a first end 21, in this embodiment the bow, and a second end 22, in this embodiment the stern. The first end 21 of the first tug unit 2 is provided with first barge attachment means 23, on the sides of said first end 21, which may be in the form of wedges for interconnection (FIG. 1) with the notches, i.e. the tug attachment means 15 discussed above. Preferably, the first barge attachment means 23 are on different levels with regard to the water level.

By having the tug attachment means and the first barge attachment means, or more particularly the tug attachment, means on different vertical levels with regard to the water level the interconnection between the barge unit and the first tug unit can more easily be made in differing loading situations of the barge unit. The first tug unit may thus remain on its designed floating level for optimum pushing performance.

The first tug unit 2 is provided with a first propulsion unit 24 at its second end 22. The first propulsion unit preferably is a conventional mechanical propulsion device with a single shaft line. The first propulsion unit 24 includes a propeller 25 and a rudder 26 as shown.

The barge unit 1 could also have corresponding tug attachment means (not shown) on the inside of the base 17 of the U-shaped second end 12 of the barge unit 1. In this case, the front of the first end 21 of the first tug unit 2 would also be provided with corresponding first barge attachment means (not shown) for interconnection with said tug attachment means. This would additionally secure and stabilize the interconnection of the barge unit and the first tug unit.

The barge unit 1 may be pushed by the first tug unit 2 with the first end 11 of the barge unit 1 in a forward direction F of motion.

Figure 4:
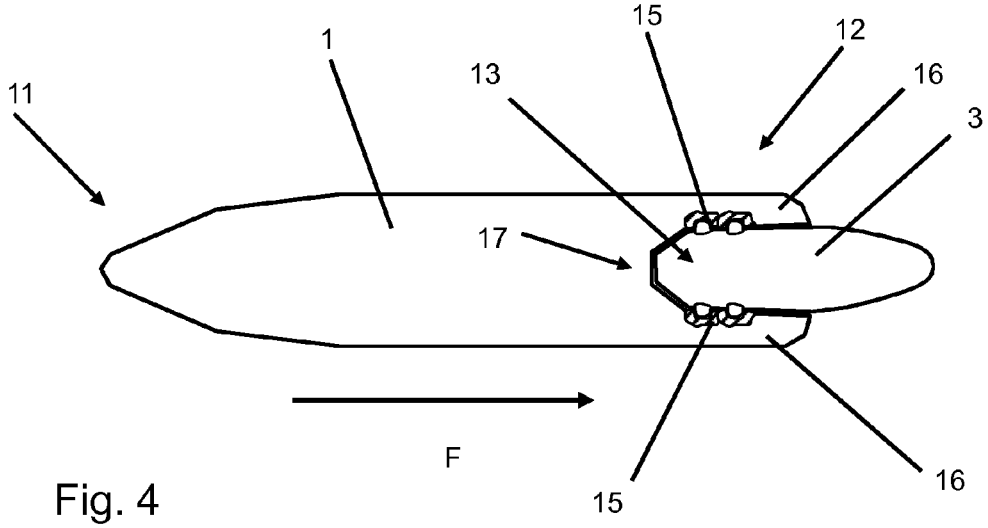
FIG. 4 shows a barge arrangement including a barge unit and a second tug unit.
Figure 5:
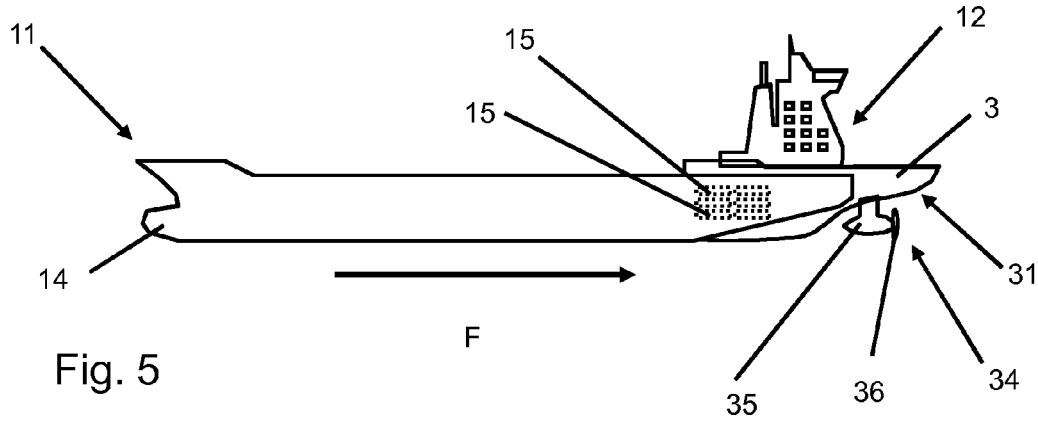
FIG. 5 shows a side view of the barge arrangement of FIG. 4.

FIGS. 4 and 5 show a barge arrangement including the barge unit 1 and a second tug unit 3. The barge unit 1 is identical to the barge unit 1 discussed above in connection with FIGS. 1 to 3, but will nevertheless be described in this connection as well.

The barge unit 1 has a first end 11, in this embodiment functioning as the stern, and a second end 12, in this embodiment functioning as the bow. The second end 12 of the barge unit 1 is adapted to receive the second tug unit 3 and has a generally U-shaped form opening towards the direction of the second end 12 and providing a recess 13 for receiving the second tug unit 3. The U-shaped second end 12, with two arms 16 and a base 17 between the arms define the recess 13. The first end 11 of the barge unit 1 is provided with a bulbous bow 14. Further, the barge unit 1 is provided with tug attachment means 15, which may be in the form of notches. Preferably, the tug attachment means 15 are on different levels (FIG. 5) with regard to the water level. The tug attachment 15 means are arranged on the inside of the arms 16 of the U-shaped second end 12 of the barge unit 1.

Figure 6:
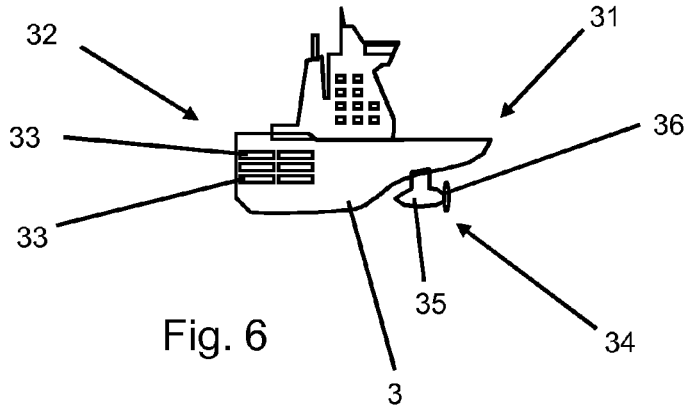
FIG. 6 shows a side view of the second tug unit of FIG. 4, and FIG. 7 to FIG. 10 illustrate an example of operation of the barge arrangement according to the invention.

The second tug unit 3 is shown in more detail in FIG. 6. The second tug unit 3 has a first end 31, in this embodiment the bow, and a second end 32, in this embodiment the stern. The second end 32 of the second tug unit 3 is provided with second barge attachment means 33, on the sides of said second end 32, which may be in the form of wedges for interconnection (FIG. 4) with the notches, i.e. the tug attachment means 15 discussed above. Preferably, the second barge attachment means 33 are on different levels with regard to the water level.

By having the tug attachment means and the second barge attachment means, or particularly the tug attachment means, on different vertical levels with regard to the waterline the interconnection between the barge unit and the second tug unit can more easily be made in differing loading situations of the barge unit. The first tug unit may thus remain on its designed floating level for optimum pulling performance.

This is of particular advantage in ice conditions, i.e. in connection with operation with the second tug 3 in its pulling mode. Ice breaking performance is more dependent on having the waterline of the ice breaking second tug unit 3 at the right level. As the first end 31 of the second tug unit 3 is designed for operation in ice, the hull has a particular configuration in order to optimize the ice breaking properties. When the barge unit 1 is provided with tug attachment means 15 on different vertical levels with regard to the waterline, the second barge attachment means 33 can always be positioned to attach to the relevant tug attachment means 15 so that its ice breaking properties are optimized as discussed above.

Especially in ice conditions it is advantageous, if the attachment means are of the articulated type. This allows for pitching, which reduces forces in ice, as well as in heavy sea conditions. Also this allows for some gap between the pulling second tug unit and the barge unit, which is a further advantage in said conditions.

The second tug unit 3 is provided with a second propulsion unit 34 at its first end 31. The second propulsion unit 34 preferably is an azimuthing electric pod propulsion device 35 including a propeller 36 as shown. The second propulsion unit could also be a steerable mechanical or electrical thruster device.

The barge unit 1 could also have corresponding tug attachment means (not shown) on the inside of the base 17 of the U-shaped second end 12 of the barge unit 1. In this case, the front of the second end 32 of the second tug unit 3 would also be provided with corresponding second barge attachment means (not shown) for interconnection with said tug attachment means. This would additionally secure and stabilize the interconnection of the barge unit and the second tug unit.

The barge unit 1 may be pulled by the second tug unit 3 with the second end 12 of the barge unit 1 in the forward direction F of motion.

FIGS. 7 to 10 illustrate an example of operation of the barge arrangement according to the invention.

This example shows the use of a first tug unit 2, a second tug unit 3 and three barge units, a first barge unit 101, a second barge unit 102 and a third barge unit 103, which barge units all are identical to the barge unit 1 discussed above in connection with FIGS. 1 to 6. The first tug unit 2 and the second tug unit 3 all also identical to the first tug unit 2 and the second tug unit 3 discussed above in connection with FIGS. 1 to 6. This means that the components discussed above will not necessarily be separately identified in this connection.

In this example a port is indicated by reference P, ice conditions are identified by reference I, and open sea by reference O. The forward direction F of motion also corresponds to the forward direction F of motion discussed in connection with FIGS. 1 to 6.

In the following the operation of the barge arrangement will be described in two modes, in a first mode of operation, which takes place in open sea O, and in a second mode of operation, which takes place in ice conditions I.

Figure 7:
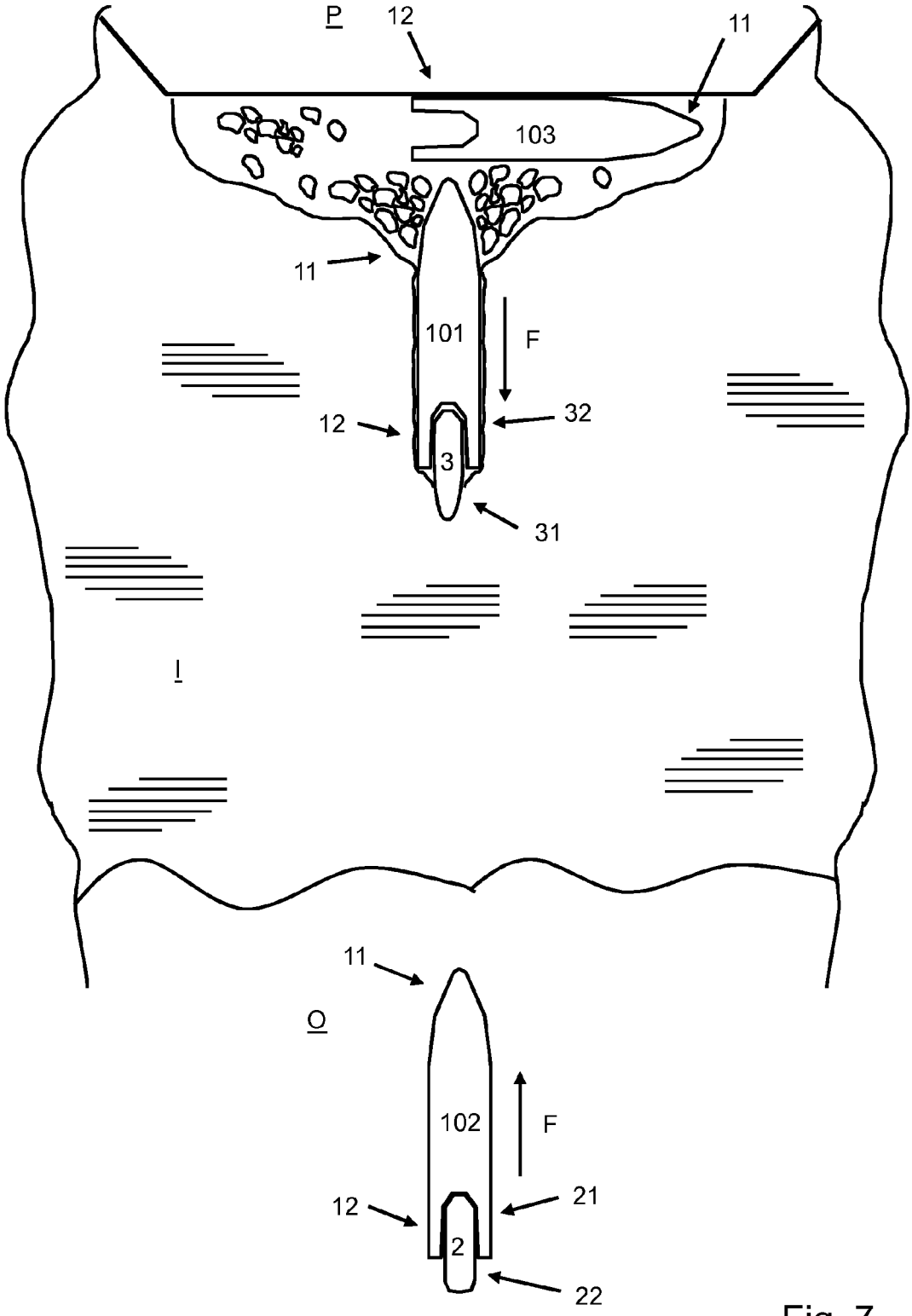

In FIG. 7 the first barge unit 101 is leaving port P being pulled by the second tug unit 3 through the ice conditions I. The first barge unit 101 and the second tug unit 3 are interconnected by the tug attachment means 15 and the second barge attachment means 33, as discussed above (FIGS. 4 to 6). The second propulsion unit 34 flushes the ice encountered by the first end 31 of the second tug unit 3 as the barge arrangement moves with the second end 12 of the barge unit 1 in the forward direction F of motion. The first end 31 of the second tug unit 3 is designed for operation in ice conditions. The first end 11 of the first barge unit 1 is designed for operation in open sea, with e.g. a bulbous bow 14 as discussed above. However, as it is trailing behind there are no disadvantages due to this design.

At the same time the second barge unit 102 sails in open sea O towards the port P. The second barge unit 102 is pushed by the first tug unit 2 with the first end 11 of the second barge unit 102 in the forward direction of motion F. In open sea O the first end 11 of the second barge unit 102 provided with a bulbous bow 14 provides an advantage in sailing. In this respect it is a further advantage that the second end 22 of the first tug unit 2 also is designed for operation in open sea, i.e. by having a design providing a more favourable inflow to the propeller 25. The first propulsion unit 24 may advantageously comprise e.g. a conventional mechanical propulsion device including a low speed engine with a single shaft line. This provides for economy both in view of construction, engine, fuel consumption and operation.

The third barge unit 103 lies in port P for loading/unloading.

Figure 8:
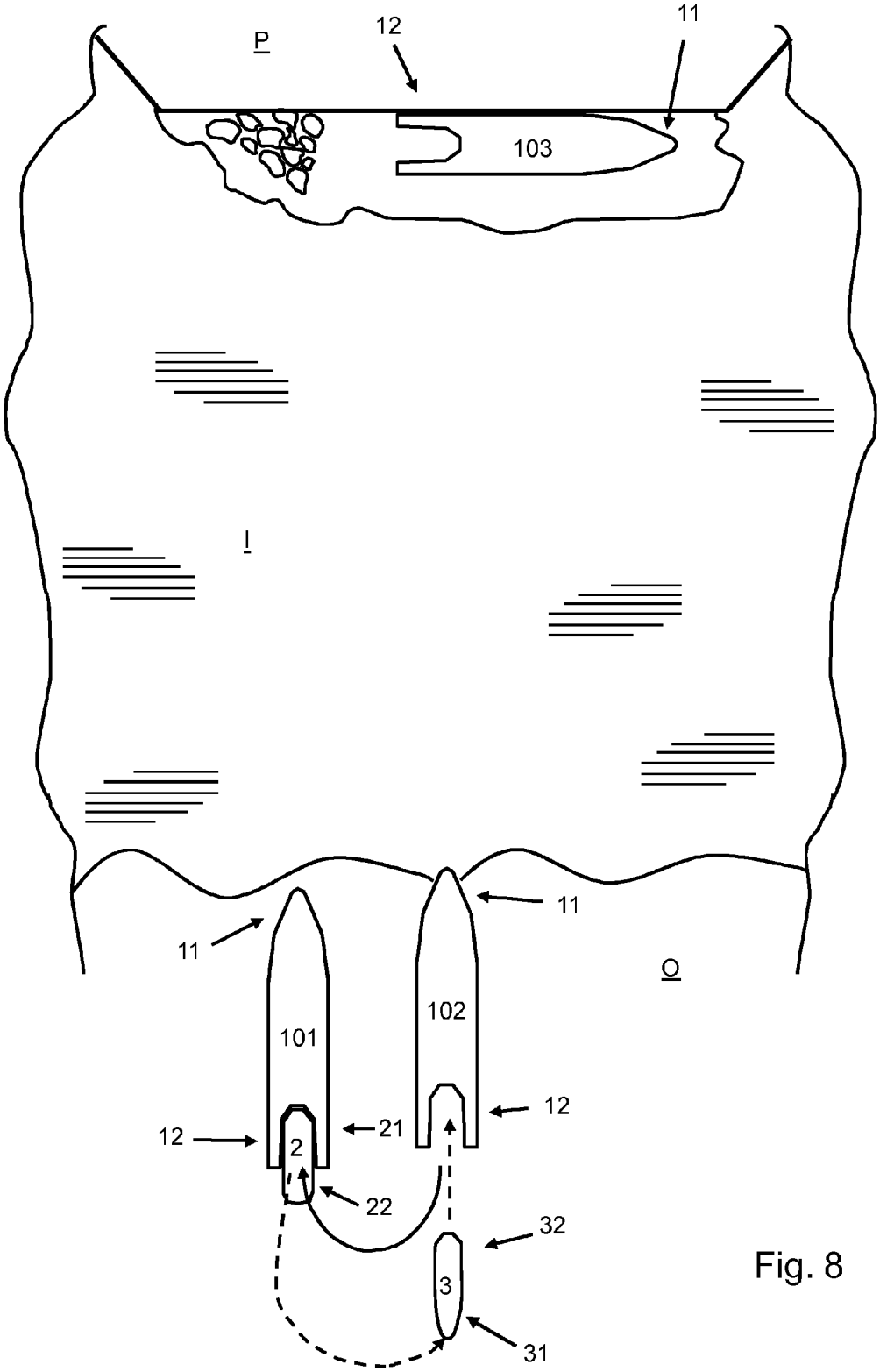
Figure 9:
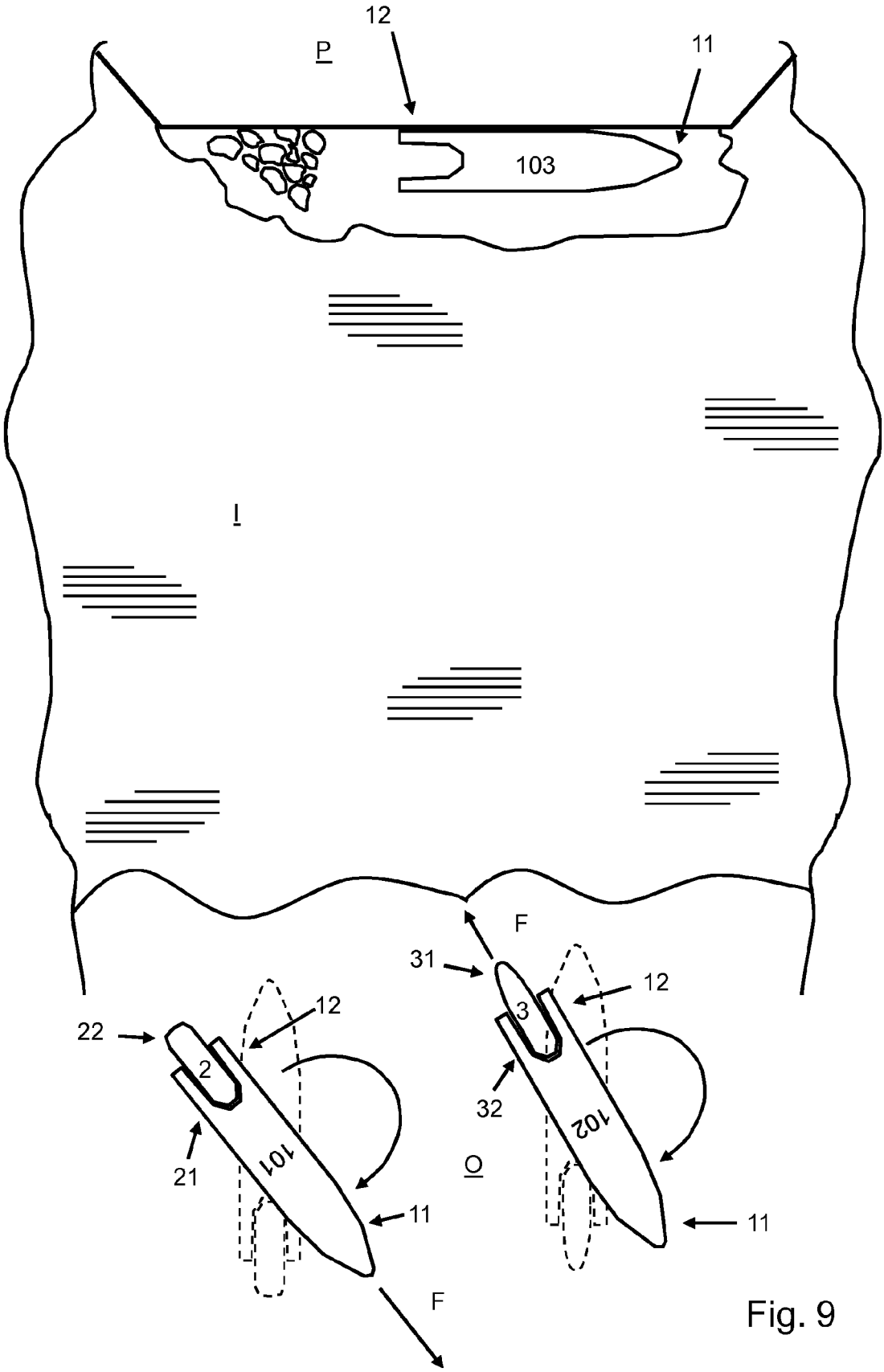

In FIGS. 8 and 9 the first barge unit 101 and the second barge unit 102 switch tug units.

When the first barge unit 101 has been pulled through the ice conditions I by the second tug unit 3, the second tug unit 3 can leave the first barge unit 101 and move towards and engage with the second end 12 of the second barge unit 102 with its second end 32 (shown with broken lined arrows in FIG. 8). When engaging, the second barge attachment means 33 of the second tug unit 3 interconnect with the tug attachment means 15 of the second barge unit 102. The second tug unit 3 is now ready to pull the second barge unit 102 through the ice conditions I into port P (FIGS. 9 and 10) in a corresponding manner as discussed in connection with FIG. 7.

Figure 10:
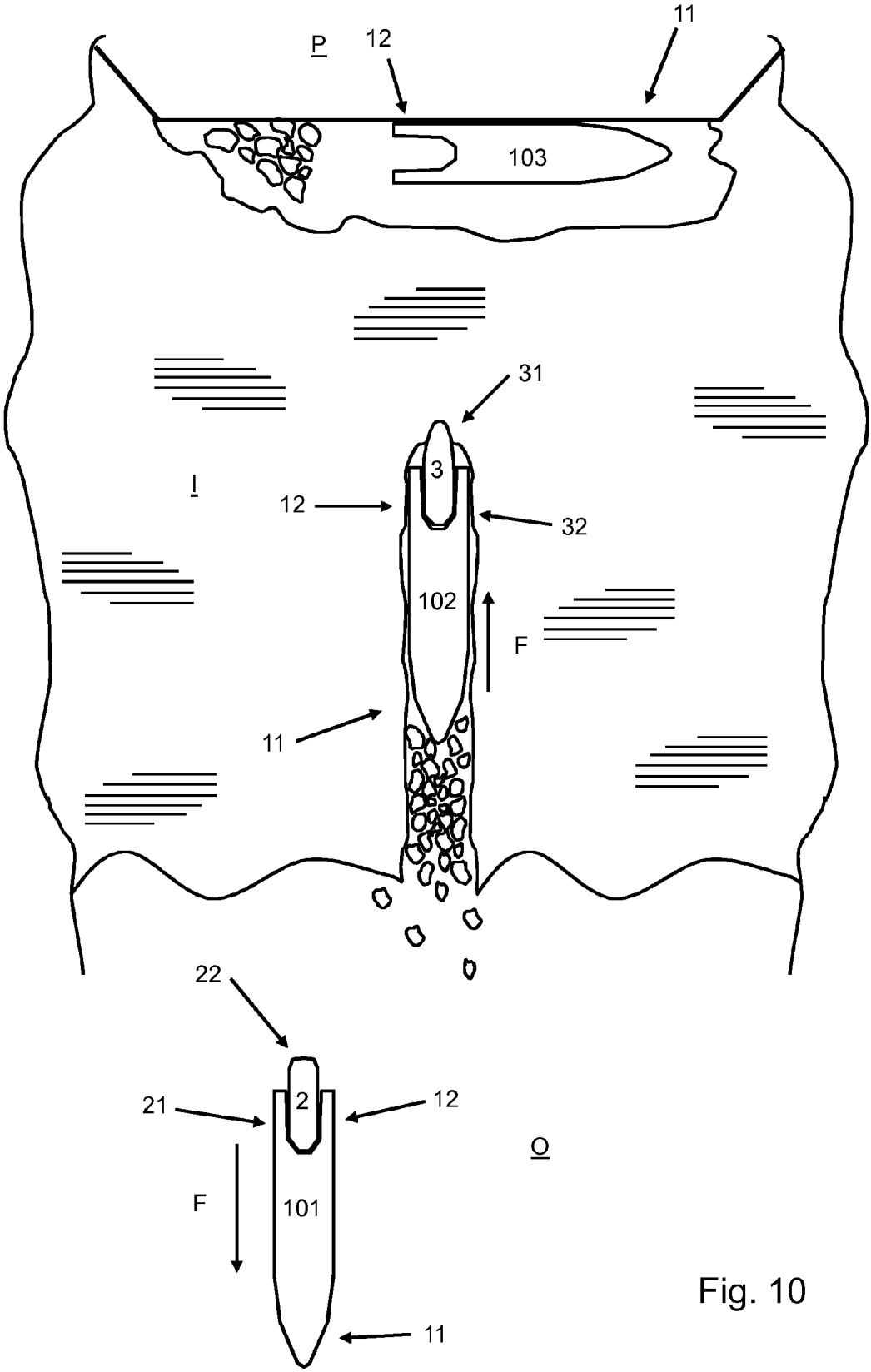

In the mean time, the first tug unit 2 has left the second barge unit 102 and engages with the second end 12 of the first barge unit 101 (shown with curved arrow in FIG. 8) in order to continue the voyage by pushing the first barge unit 101 with the first end 11 of the barge unit in the forward direction of motion F through open sea O to a desired destination (FIGS. 9 and 10).

In FIG. 9 it is shown how the barge unit and tug unit combinations have turned in order to assume their respective forward direction F of motion. The positions of FIG. 8 are shown in dotted lines.

The third barge unit 103 is still in port in order to load/unload cargo and waits to be taken out through the ice conditions I towards open sea O by the second tug unit 3 steaming in to port P.

FIG. 10 shows an inverted situation vis a vis FIG. 7. The first barge unit 101 is pushed by the first tug unit 2 on the open sea O while the second barge unit 102 is pulled by the second tug unit 3 through the ice conditions I towards the port P. When the second barge unit 102 with the second tug unit 3 arrives in port, the second barge unit 102 can be left to load/unload, whereby the second tug unit 3 can engage with the third barge unit 103 in order to pull it through the ice conditions I out to open sea O with the second end 12 of the third barge unit 103 in the forward direction of motion in a corresponding manner as described in connection with FIG. 7. When this barge unit and tug unit combination arrives at open sea O, the second tug unit 3 can leave the third barge unit 103 and pick up the following barge unit waiting to be pulled into port P, in a manner as discussed above.

In ice conditions, i.e. in arctic circumstances, operation in ice often is only for short distances and most of the time is spent in open sea. Thus, a high efficiency and economy is achieved by using the two complementary tug units, one specialised for ice conditions and one specialised for open sea, in combination with identical barges.

The tug unit specialised for operation in ice conditions, i.e. the pulling second tug unit, can be used more or less only for operation in ice. This means that its first end (bow end) may be designed specifically for ice conditions, i.e. for ice breaking purposes. Furthermore, the second propulsion unit at its first end may also be chosen for this specified purpose, i.e. it may be a rotatable electric pod propulsion device, which in addition for pulling the load can efficiently be used for flushing the ice from the bow end of the second tug unit. Consequently, the expensive propulsion machinery can be utilised as much as possible for the intended use. In addition, an optimal crew can be chosen, i.e. a crew with thorough ice breaking knowledge.

The tug unit specialised for operation in open sea, i.e. the pushing first tug unit, can be used only for operation in open sea. This means that its second end may can be designed for operation in open sea, i.e. a design providing for optimal inflow of water to the propeller along an appropriate conventional keel line. Furthermore, the first propulsion unit may be a conventional mechanical propulsion device (as discussed above), with low investment and operation costs. The crew does not necessarily have to have any specified competence above normal requirement.

The barge unit, i.e. each of the first barge unit, the second barge unit and the third barge unit, as in the example above, may principally be designed for open sea, i.e. having a bulbous bow at the first end. On one hand, the bulbous bow in front provides for good sailing in open sea when pushed by the first tug unit, where as on the other hand, the bulbous bow when trailing as the barge unit is pulled through ice conditions by the second tug unit, does not have any negative effects.

In order to give good maneuvering characteristics, the second end of the barge unit can be designed for interconnection with the first end of the first tug unit and with the second end of the second tug unit in order to form an integral hull configuration for providing a streamlined motion in the forward direction.

Particularly the U-shaped second end 12 of the barge unit, with its arms 16 forming the tug unit receiving recess 13, and the first end 21 of the first tug unit 2 are designed for providing the streamlined motion for operation in open sea O.

In a corresponding manner the U-shaped second end 12 of the barge unit, with its arms 16 forming the tug unit receiving recess 13, are designed to receive the second end 32 of the second tug unit 3 for providing the streamlined motion for operation in ice conditions I. Advantageously the arms 16 are also shaped to form a good icebreaking hull with the second tug unit 3.

Typical applications in this regard are arctic LNG carriers, arctic tankers, arctic container vessels, arctic general cargo vessels, etc.

In the above the varying conditions have been discussed as relating to a first mode of operation in open sea and a second mode of operation in ice conditions.

Other varying conditions may also be contemplated. As an example, the barge arrangement could e.g. be used in a first mode of operation for river transportation, where the first tug unit could be designed for operation in shallow silent waters typical for rivers. The second mode of operation could be in open sea with heavy, high and rough sea, where the second tug unit could be designed as a ocean going tug unit. These conditions would also have their influence on preferable propulsion units, design of the barge unit and competences of the crew.

The tug attachment means and the barge attachment means may also include an articulated type connection. This would allow pitching, which would be advantageous in ice or heavy sea conditions. Advantageously there would also be a gap between the pulling second tug unit and the barge unit in such conditions.

It is clear that the number of barge units and tug units may vary according to the circumstances in which the barge arrangement is used, where factors such as operating distances, loading/unloading speed, etc. may vary.

The description and drawings related thereto are only intended to clarify the basic idea of the invention. The invention may vary in detail within the scope of the ensuing claims.

The invention claimed is:

1. A barge arrangement comprising:

a barge unit with a first end and a second end, a first tug unit with a first propulsion unit, and a second tug unit with a second propulsion unit, and wherein the barge unit is adapted to receive the first tug unit at its second end in order to be pushed by the first tug unit with the first end of the barge unit in a forward direction of motion for operation in open sea, and the barge unit is adapted to receive the second tug unit at its second end in order to be pulled by the second tug unit with the second end of the barge unit in the forward direction of motion for operation in ice conditions, and wherein the second tug unit is provided with an ice breaking bow.

2. A barge arrangement according to claim 1, wherein the first end of the barge unit is designed for operation in open sea, the first tug unit has a first end for engaging the barge unit at the second end of the barge unit for pushing the barge unit and has a second end designed for operation in open sea, and the second tug unit has a stern for engaging the barge unit at the second end of the barge unit for pulling the barge unit.

3. A barge arrangement according to claim 2, wherein the first end of the barge unit has a bulbous bow.

4. A barge arrangement according to claim 1, wherein the barge unit has a tug attachment structure at its second end, the first tug unit has a first barge attachment structure at a first end of the first tug unit and a first propulsion unit at a second end of the first tug unit, and the second tug unit has a second propulsion unit at a first end of the second tug unit and a second barge attachment structure at a second end of the second tug unit.

5. A barge arrangement according to claim 4, wherein the tug attachment structure comprises a plurality of tug attachment elements at different vertical levels with respect to the waterline, whereby the first or second tug unit can engage the barge unit at different levels.

6. A barge arrangement according to claim 4, wherein the first propulsion unit comprises a shaft driven propeller and the second propulsion unit comprises an electric pod propulsion device, and the first tug unit further comprises a rudder.

7. A method of operating a barge arrangement comprising a barge unit with a first end and a second end, a first tug unit with a first propulsion unit, and a second tug unit with a second propulsion unit, the method comprising, in a first mode of operation, engaging the first tug unit with the second end of the barge unit for pushing the barge unit with the first end of the barge unit in a forward direction of motion for operation in open sea, and in a second mode of operation, engaging the second tug unit with the second end of the barge unit for pulling the barge unit with the second end of the barge unit in a forward direction of motion for operation in ice conditions.

8. A method according to claim 7, wherein the barge unit comprises a tug attachment structure at the second end thereof, the first tug unit has a first barge attachment structure at a first end of the first tug unit and a first propulsion unit at a second end of the first tug unit, and the second tug unit has a second propulsion unit at a bow of the second tug unit and a second barge attachment structure at a stern of the second tug unit, the bow of the second tug unit is an ice breaking bow, the first mode of operation includes engaging the first barge attachment structure with the tug attachment structure, and the second mode of operation includes engaging the second barge attachment structure with the tug attachment structure.

* * * * *